United States Patent [19]

Bamford

[11] Patent Number: 4,947,775

[45] Date of Patent: Aug. 14, 1990

[54] WATER AIR INTERFACE VEHICLE

[76] Inventor: Robert M. Bamford, 1555 Parway Dr., Glendale, Calif. 91206

[21] Appl. No.: 192,934

[22] Filed: May 12, 1988

[51] Int. Cl.[5] ..... B63H 9/00

[52] U.S. Cl. ..... 114/39.1; 114/126; 114/274

[58] Field of Search ..... 114/39.1, 102, 103, 114/123, 126, 272, 274; 244/2, 105

[56] References Cited

U.S. PATENT DOCUMENTS 3,295,487 1/1967 Smith ..... 114/39.1

4,592,298 6/1986 Finot ..... 114/39.1

*Primary Examiner*—Joseph F. Peters, Jr.

*Assistant Examiner*—Jesûs D. Sotelo

*Attorney, Agent, or Firm*—Albert O. Cota

[57] ABSTRACT

A water and air supported vehicle propelled by the wind. The vehicle includes a long narrow hull (30) that displaces water at low speeds and a plurality of hydrolfoils (36) distending from the hull in communication with the water resisting lateral loads and at high speeds partially supporting the vehicle. An airfoil (38) whose section is suitable for a membrane surface is pivotally attached to the hull and acts to partially support and provide thrust to propel the vehicle. A strut and a plurality of tendons (58), (60), (62), (64) and (72) position the airfoil relative to the hull (30) and articulate the airfoil when manually actuated. The shape of the airfoil tips elements (46) provide vehicle roll resistance when they penetrate the water surface and a payload is supported by a hull torque link (66) and a cantilever beam (90) with a sling (92) positioned therebetween. Other embodiments articulate the hydrofoils in concert or include a payload containing capsule (112).

21 Claims, 10 Drawing Sheets

WATER AIR INTERFACE VEHICLE

TECHNICAL FIELD

The present invention relates to water air interface vehicles in general and more specifically to a vehicle that supports and propels a payload, including the operator, using an airfoil for partial support and thrust to propel the vehicle through the water and a water borne hull with hydrofoils providing the remaining support and resistance to lateral loads unavoidably induced on the airfoil.

BACKGROUND ART

Previously, many vehicles have been developed using hydrofoils or buoyant supports in combination with a propulsion system in the water and airfoils have long been in use for lifting airborne payloads. Hull shapes, airfoil and hydrofoil arrangements and the controls suitable for a gradual transition from buoyant to dynamic support have not been described in the prior art. This is particularly evident with an airfoil providing partial support and thrust and with the hull, including hydrofoils, also providing partial support and with the airfoils and hydrofoils supporting a gradually increasing fraction of the weight as speed increases. The combination of a water sustained hull and a warpable beam airfoil has indeed been lacking.

A search of the prior art did not disclose any patents that read directly on the claims of the instant invention, however, the following U.S. Pat. Nos. were considered related:

| U.S. PAT. NO. | INVENTOR | ISSUED |
|---|---|---|
| 3,987,982 | Amick | 24 October 1976 |
| 3,295,487 | Smith | 3 January 1967 |
| 1,949,818 | Tarbox | 6 March 1934 |
| 1,613,890 | Herreshoff | 11 January 1927 |
| 1,356,300 | McIntyre | 19 October 1920 |

Amick teaches a combination sailplane and a sailboat with large dihedral of the wing and tail surfaces and buoyant wing tip end plates to resist capsizing at low speeds. In the sailing mode, the leeward wing is approximately horizontal and the windward wing acts as a sail, supplying the necessary horizontal component of the air load.

Smith discloses a hydrofoil sailboard with a single diagonal sail wing. The side forces of the sail are resisted by hydrodynamic forces of the hulls centerboard, daggerboard or vertically oriented hydrofoils. In one embodiment, the sailboard contains fore and aft air rudders.

Tarbox teaches a non-planar truss member for aircraft wings with flat sheet metal parts with a portion readily joined to a longitudinal member. The truss is a combination of triangles formed with constituent cap strips and triangulated beading. Its embodiment would have only incidental torsional flexibility, however, as indicative of the state-of-the-art.

Herreshoff introduced the importance of a foil shaped sail in use on a conventional hull with a centerboard for stability. The sail had the shape of a cambered airfoil, however, it was utilized in a vertical position relative to the hull.

McIntyre disclosed a pair of hydrofoils mounted on outriggers inclined approximately 45 degrees to the vertical such that they provide lift as well as side forces.

As the speed increases, the hydrofoils tend to lift the center hull out of the water.

DISCLOSURE OF THE INVENTION

In accordance with the present invention, two major components are taught including a long narrow hull that has a means of supporting the payload, also a fore and aft plane of symmetry and one or more sets of hydrofoils to resist lateral loading and to partially support the vehicle. The second component is an airfoil having a plane of symmetry normal to its span, offset from the hull, tilted relative to vertical and with its leeward tip at or near the water's surface when operational. The airfoil partially supports the payload and provides the thrust to propel the vehicle relative to the water.

The airfoil and hull are interconnected through two axes (either real or virtual) in series. The first axis is approximately parallel with and both functionally and physically closer to the hull longitudinal axis. The second axis is approximately vertical, approximately through the vehicle plus payload center of gravity and functionally closer to the airfoil. The payload is located on the opposite side of the hull from the airfoil in such a way that it balances most of the airfoil weight using the hull as a fulcrum. When in static force and moment equilibrium, the buoyant plus hydrodynamic force resultant on the vehicle must be in the same vertical plane through the center of gravity of the vehicle plus payload. The force resultants must intersect on a vertical line through the center of gravity. The horizontal components of these force resultants must have the same magnitude and be oppositely directed. The sum of upward components of the force resultants must be equal to the vehicle plus payload weight. Tilt of the airfoil and hydrofoils (which varies with hull roll) allows the intersection previously mentioned to be closer to the center of gravity vertically and closer to the airfoil with smaller variation laterally than without the tilt. Adjustment to the airfoil tilt or hull roll are alternatives to shifting the center of gravity laterally. Rotation of the airfoil about its pitch axis and/or the vertical axis through the center of gravity are alternatives to shifting the center of gravity fore and aft.

The symmetry of the components and their interconnection implies the existence of a symmetrical configuration of the vehicle as a whole. The overall symmetrical configuration with the maximum airfoil lift is a transition configuration between the two operational configurations. Each operational configuration is reached from the symmetric configuration by raising the windward airfoil tip, tilting the hull about its roll axis until the hydrofoils resist the lateral forces from the airfoil and rotating the airfoil assembly forward to develop thrust.

The unbalanced portion of the airfoil weight is supported by forces on its leeward tip which is at or near the water surface. Motion of the airfoil (relative to the hull) about a near vertical axis (real or virtual) allows course adjustment while maintaining the aerodynamic resultant force intersecting a vertical line through the center of gravity of the vehicle plus its payload. The hull and airfoil tip can be supported by displacing water, by the normal force on a planing surface or by the lift of hydrofoils. The latter two forms of support can also react lateral loading on the hull induced by aerodynamic forces on the airfoil.

The airfoil is warpable to compensate for the variation in relative wind direction with distance above the water and to allow controlling the distribution of load along the airfoil The features of combining a long narrow hull with hydrofoils and a warpable airfoil to provide partial support and thrust is a distinct improvement over prior art vehicles which have been water supported and used aerodynamic forces principally for propulsion.

BEST MODE FOR CARRYING OUT THE INVENTION

Figure 1:
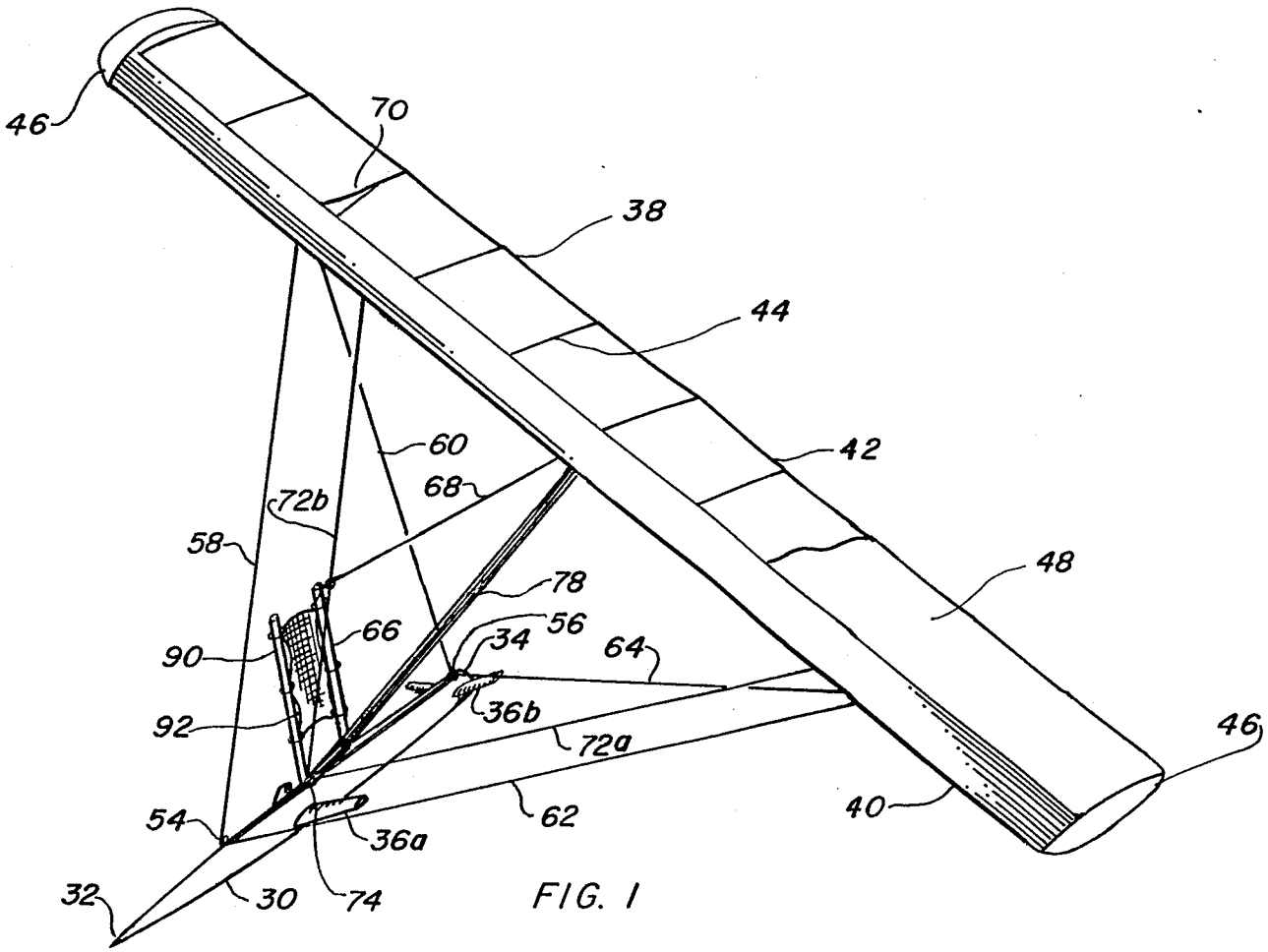
FIG. 1 is a partial isometric view of the preferred embodiment as seen from the front of the vehicle in the operational configuration for a starboard tack.

The best mode for carrying out the invention is presented in terms of a preferred and a second through fourth embodiment. All embodiments are primarily designed alike with the exception of the hydrofoil attachment, the leading edge spar, the addition of a payload capsule and an extra adjustment of the airfoil.

The preferred embodiment as shown in FIGS. 1 through 9, 11 through 20, is comprised of a waterair interface vehicle that supports and propels a payload.

The vehicle has a long narrow hull 30 having a plane of symmetry along the longitudinal axis. The hull 30 has a bow 32 and a stern 34 best illustrated in FIG. 1. The hull 30 partially supports the vehicle in the water at low speeds by displacing a volume of water of equal weight. A section area distribution independent of the volume of water displaced and water surface width distribution independent of the water displaced maintains similar hull hydrostatic, hydrodynamic and stability properties for the hull as the displacement changes FIGS. 19 and 20 graphically depict these characteristics of the hull 30. The hull 30 further has one or more section slope discontinuities on the surface of said hull, having an internal angle at the discontinuity of less than 180 degrees. These discontinuities are designated 30*a* in the drawings best depicted in FIGS. 3 through 6. The hull 30 may be made of any material suitable for the application having the necessary structural integrity and water resistance.

Figure 19:
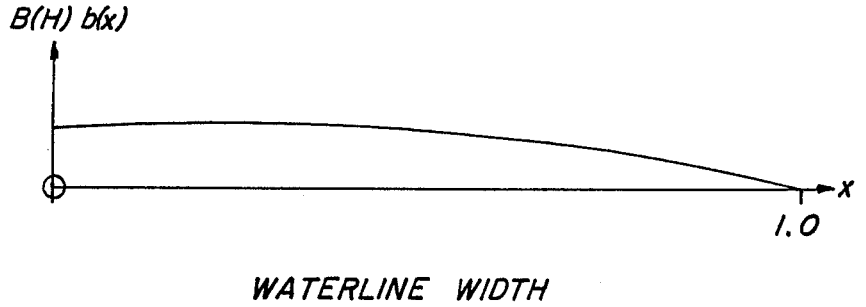
FIG. 19 is a graph illustrating the water line width distribution corresponding to the dotted line in FIG. 20.
Figure 20:
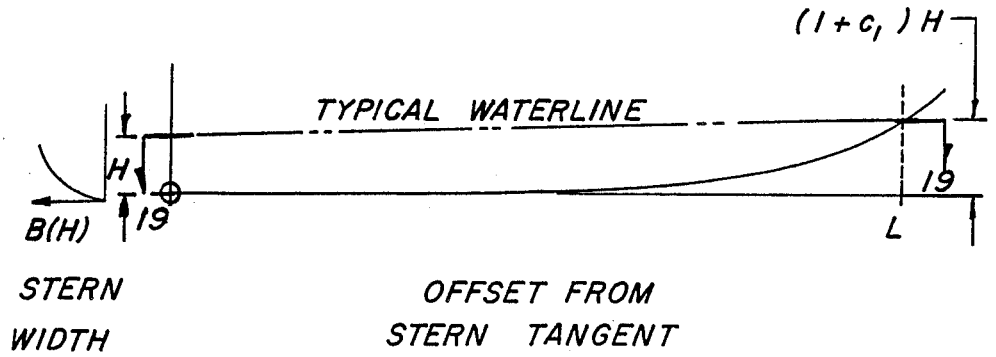
FIG. 20 is a graph illustrating the stern width and bow offset from a stern tangent and a typical water line.

FIGS. 19 and 20 graphically illustrate the preferred shape of the hull which correlates with the following formula:

let L be the waterline length projected on a longitudinal tangent at the stern. Given a stern submergence H, a waterline width equal to the product of a constant width distribution b(x) times the stern width B(H) and a bow offset from the longitudinal tangent at the stern to the water surface proportional to H. Where x is the distance along the tangent from the stern divided by L. The area distribution will be constant if the stern area (A) is proportional to a power of L, therefore:

$$A = \int_{o}^{H} B(h)dh = C_2 L^{C_3}$$

The ratio of tangent offset to stern submergence $(1+C_1)$ as well as $C_2$, $C_3$, and the distributions b(x) and B(H) are arbitrary except the value of b must be unity at the stern.

$b(o)=1$

The section area (A(x)) is equal to the product of A which is a function of H and the constant area distribution (a(x)) which is a function of x not L, therefore:

$$a(x) = C_3 x^{C_3} \int_x^1 b(y)(1 + C_1 y)/y^{1+C_3} dy$$

A plurality of hydrofoils 36 are symmetrically attached to the hull 36. These hydrofoils 30 partially support the vehicle at high speeds relative to the water and resist lateral loads on other parts of the vehicle.

The hydrofoils form one or more sets with each set including a main foil **36*a* and one or more smaller foils 36*b*. All elements of a set are attached near a single one of the discontinuities 30*a* providing greater submergence of the foils than if they were attached to a smooth contour. The sets are attached in a symmetrical pattern onto the hull 30. The main hydrofoils 36*a* are disposed upon the hull close to and forward of the vehicle center of gravity and each smaller foil 36*b*** is located on the hull aft of the center of gravity with the smaller aft foils having a smaller angle of attack relative to the water than said main foils providing pitch stability.

Figures 2, 3, 4, 5, 6, 7:
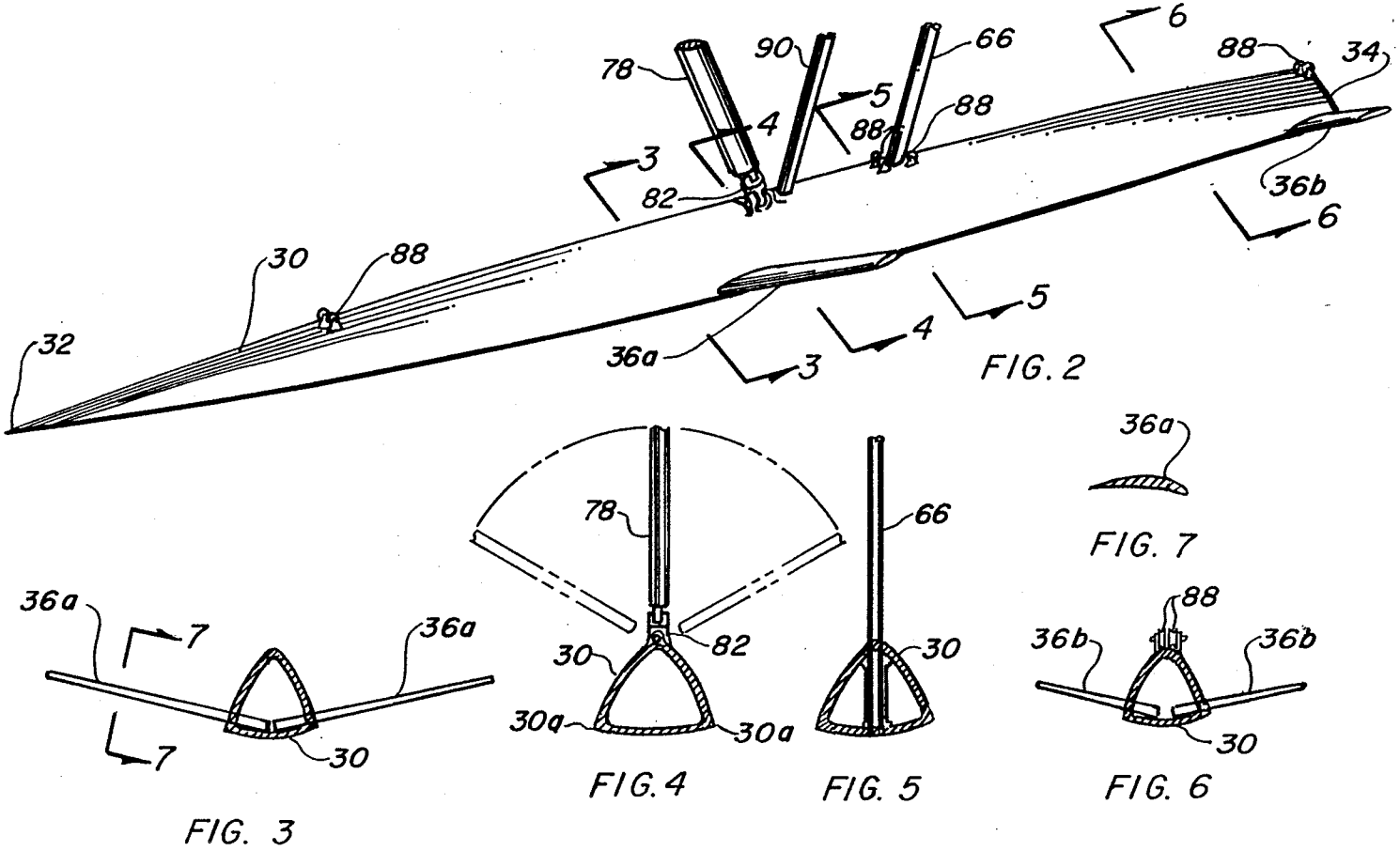
FIG. 2 is a partial isometric view of the hull completely removed from the remainder of the invention for clarity.
FIG. 3 is a cross-sectional view taken along lines 3—3 of FIG. 2 illustrating the relationship of the front hydrofoils to the hull.
FIG. 4 is a cross-sectional view taking along lines 4—4 of FIG. 2 illustrating the relationship of the airfoil support strut to the hull.
FIG. 5 is a cross-sectional view taken along lines 5—5 of FIG. 2 illustrating the relationship of the hull torque link to the hull.
FIG. 6 is a cross-sectional view taken along lines 6—6 of FIG. 2 illustrating the relationship of the rear hydrofoil to the hull.
FIG. 7 is a cross-sectional view taken along lines 7—7 of FIG. 3 illustrating the cross-sectional shape of a hydrofoil.
Figure 8:
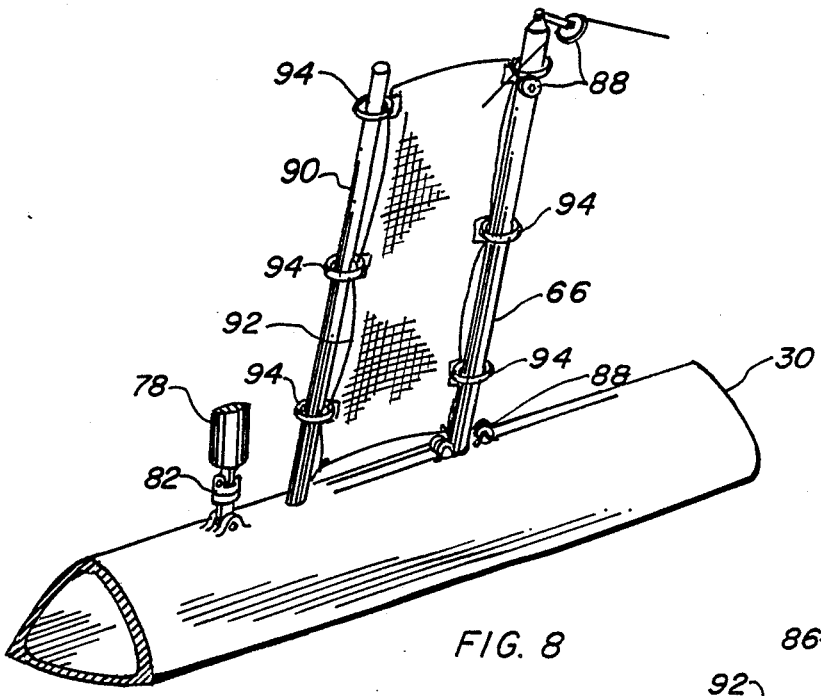
FIG. 8 is a partial isometric view of the preferred embodiment illustrating the hull torque link, the payload support specific cantilever beam and the payload support sling.

Hydrofoils comprise a first and second set of hydrofoils, the first set of hydrofoils are cambered for and used on a starboard tack and the second set of hydrofoils are cambered for and used on a port tack. The foil sets develop forces in the opposite direction for opposed tacks. This relationship is best depicted in FIGS. 3, 6 and 7 with the second set illustrated in FIG. 2 as they are both used on the port tack. The cross-sectional streamlined and cambered shape of the hydrofoil is pictorially illustrated in FIG. 7.

The vehicle utilizes an airfoil 38 having an airfoil tip element 46 on each of the two ends of its span and a plane of symmetry perpendicular to its span. The airfoil partially supports and provides thrust to propel the vehicle through the water. Alternatively, the hydrofoils provide the thrust to drive the vehicle through the air and the airfoil resists lateral loads on other parts of the vehicle.

The airfoil 38 is warpable allowing compensation for the variation in relative wind direction at different distances above the water and adjusting the distribution of pressure along the airfoil span.

Figure 11:
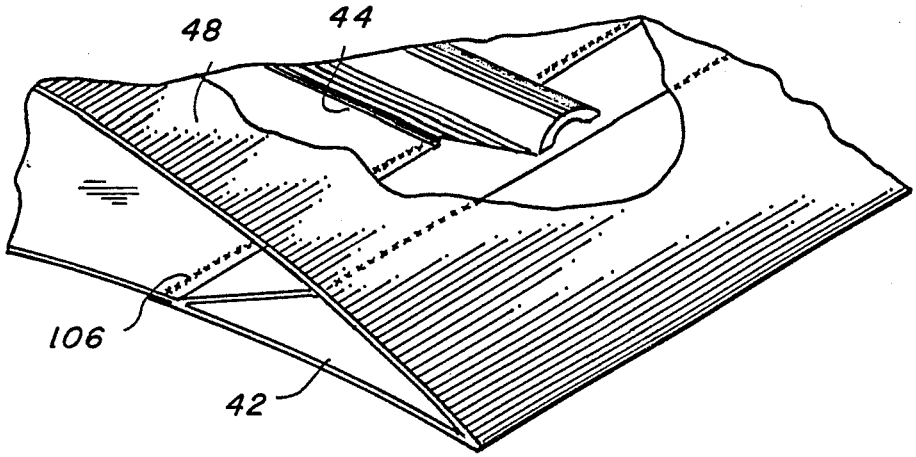
FIG. 11 is a partial cutaway isometric view of the triangular trailing edge element and its junction with a strut from the top of the leading edge spar.
Figure 12:
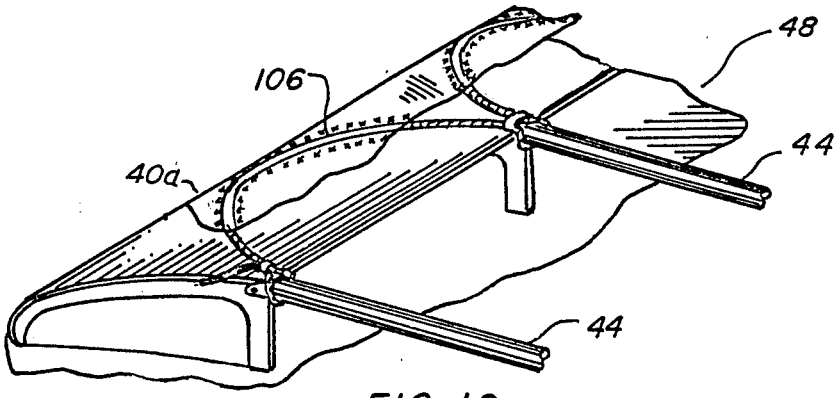
FIG. 12 is a partial cutaway isometric view of a tendon in a pocket directly in the membrane.

Shear transfer devices 106, as shown in FIGS. 11 and 12, assure the airfoil membrane 48 has an appropriate airfoil shape.

The airfoil 38 includes a torsionally flexible leading edge spar 40 as the main longitudinal structural element of the airfoil, allowing warping to maintain the proper relative position of other elements of the airfoil attached to the leading edge spar 40. In particular, the bottom chord of the airfoil 38 is more closely aligned with the hull than the chord at the top.

A trailing edge structural element 42 having a cross sectional shape appropriate for the trailing edge spar is employed by the airfoil 38. The trailing edge structural element 42 is in an appropriate position relative to the airfoil cross section and is held in this location by a plurality of chordwise elements 44 positioned uniformally spaced therebetween and the lower surface membrane.

The airfoil tip elements 46 have a contoured shape suitable for planing on a water surface providing means to support the leeward tip of airfoil 38 and also suitable for their function as the tip of an airfoil.

Each airfoil tip element 46 has a kinematic attachment to the leading and trailing edge structure 40 and 42. The airfoil 38 further has a membrane 48 covering the external surface in the regions bounded by the leading edge spar 40, the trailing edge structural element 42 and the airfoil tip elements 46.

The vehicle contains airfoil positioning means consisting of a number of lines and a strut between the airfoil 38 and the hull 30. A first attachment point 50 is located on the airfoil 38 near the windward end and a second attachment point 52 is positioned in symmetric relationship to the first attachment point 50 near the leeward end of the airfoil 38.

A third attachment point 54 is located in the hull 30 on the hull plane of symmetry near the bow 32 and a fourth attachment point 56 is located in the hull 30 on the plane of symmetry near the stern 34.

Figure 14:
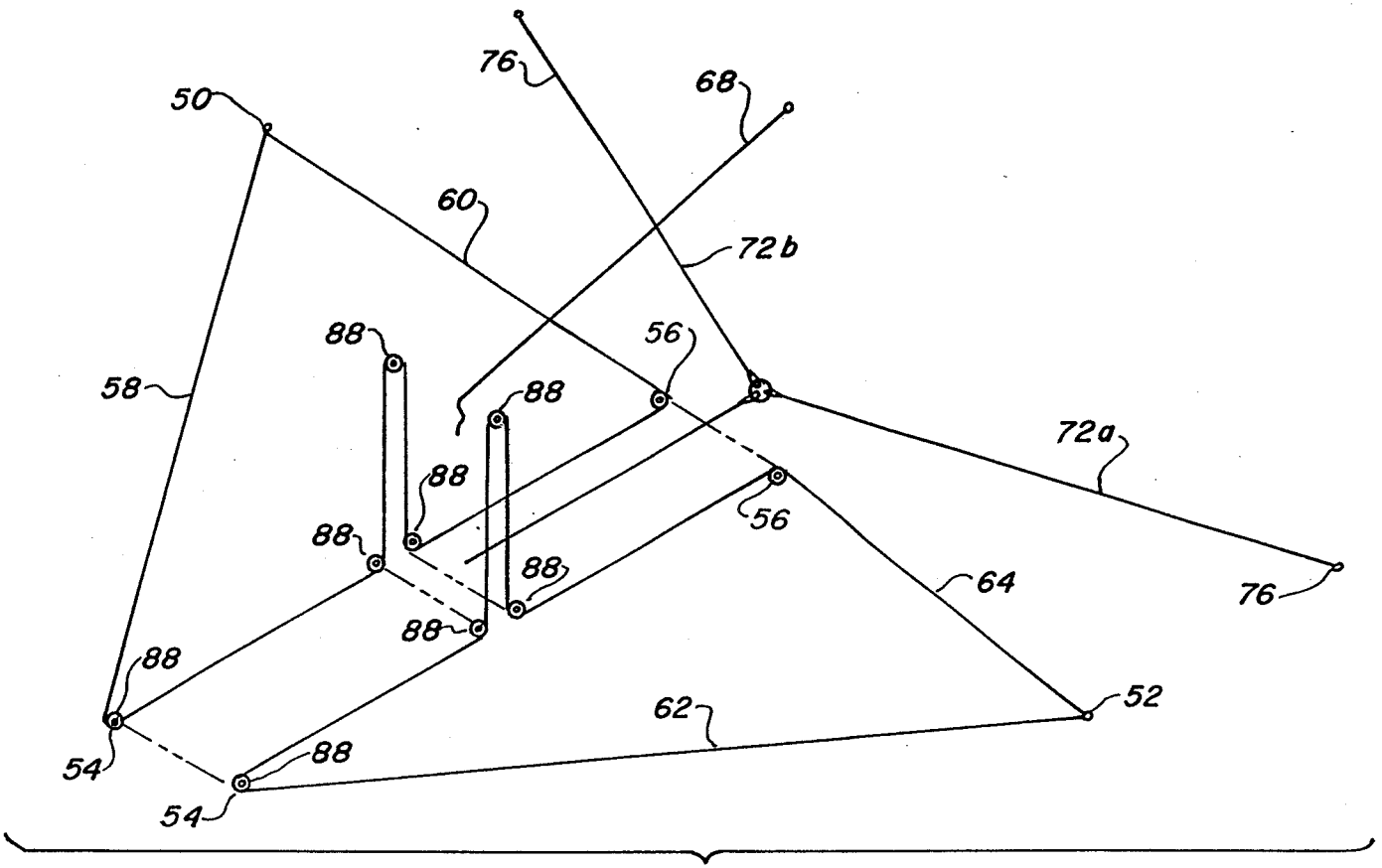
FIG. 14 is a schematic isometric of the tendons illustrating their relationship one to the other completely removed from the remainder of the invention for clarity.

These attachment points 50 and 52 on the airfoil 38 are fixed while the attachment points 54 and 56 on the hull 30 which provide for control contain a direction changing device as shown in FIGS. 1 and 14.

Airfoil positioning means are disposed between the hull 30 and the airfoil 38 locating the airfoil 38 offset to the leeward side of the hull 30 with one airfoil tip element 46 further to the leeward and lower than the other. This positioning means includes the following: a first tendon 58 is attached rigidly on one end to the first attachment point 50 and on the other end to the third attachment point 54.

A second tendon 60 is attached on one end to the same first attachment point 50 and on the other end to the fourth attachment point 56.

A third tendon 62 is attached on one end to the second attachment point 52 and on the other end to the third attachment point 54.

A fourth tendon 64 is attached on one end to the second attachment point 52 as above and the other end to the fourth attachment point 56. The first through fourth tendons 58, 60 62 and 64 form four of the edges of a tetrahedron, the portion of the hull 30 from the third 54 to fourth 56 attachment points and the portion of the airfoil 38 from the first 50 to second 52 attachment points form the other two edges of the tetrahedron the above tendons transmit loads imposed on the airfoil 38 to the hull 30. These tendons may be metallic cables, fabric ropes or lines or any material suitable for the purpose with equal ease.

A hull torque link 66 in the form of a rigid member is attached on one end to the hull 30 in the hull plane of symmetry and the other protrudes from the hull 30 and is open. This torque link 66 allows rotational loads imposed on the hull 30 by the hydrofoils 36 to be reacted by a force at the open or top end distending from the hull 30. The link 66 is rigidly attached with rotational fixity to the hull 30.

A fifth tendon 68 is attached on one end to the hull torque link 66 open end and on the other end to the airfoil 38 in the airfoil plane of symmetry. Moments on the hull 30 due to the weight of the airfoil 38 on the hull leeward side balance moments on the hull from the weight of a payload on the hull windward side.

At least two airfoil torque links 70 each having one end attached to the airfoil leading edge spar 40 and the other end aft of the first open, allowing rotational loads on the airfoil 58 imposed by aerodynamic forces to be reacted by forces on their open ends. These airfoil torque links 70 are best depicted in FIG. 1 and preferably include guys from the open end to widely space points on the leading edge spar 40 to allow a structurally sound attachment.

A sixth tendon 72 is composed of one or more airfoil pitch control tendons 72*a* and 72*b* each attached on one end to one of the airfoil torque links 70 open end 76 and on the other end to a fifth attachment point 74 on the hull in the hull plane of symmetry. This arrangement allows airfoil warping, control and transmission of loads from the hull 30 to the airfoil torque links 70 open ends.

The airfoil 38 includes at least two airfoil torque links 70, each associated with one of the pitch control tendons, widely separated from each other and kinematically attached to the airfoil leading edge spar 40 allowing controlled warping.

The fifth attachment point 74 is positioned to coordinate airfoil angle of attack with the airfoil rotation about a near vertical instantaneous axis.

The airfoil pitch control tendons 72*a* and 72*b* forming the sixth tendon 72 have a length at their hull end coalesced into a single element with the length selected to coordinate airfoil warping with respect to airfoil loading. This provides automatic pitch control as an alternate to manual operation.

An airfoil support strut 78 is attached on one end to the airfoil 38 near the tetrahedron edge between said first and second attachment points 50 and 52 on the airfoil plane of symmetry and on the other end to the hull 30 near the tetrahedron edge between the third and fourth attachment points 54 and 56 in the hull plane of symmetry transmitting axial loads from the airfoil 38 to the hull 30.

Figure 18:
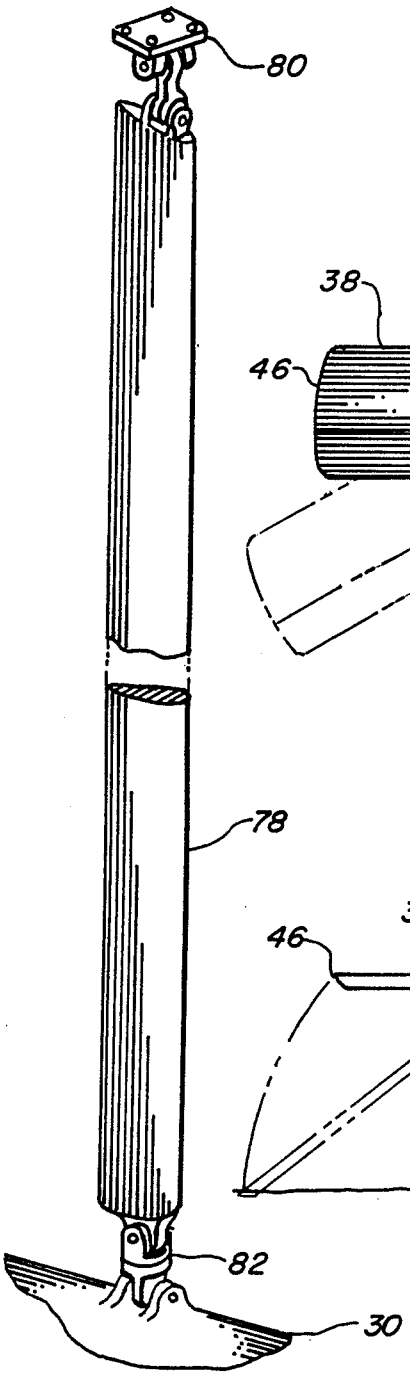
FIG. 18 is a partial isometric view of the airfoil support strut completely removed from the remainder of the invention for clarity.
Figure 15:
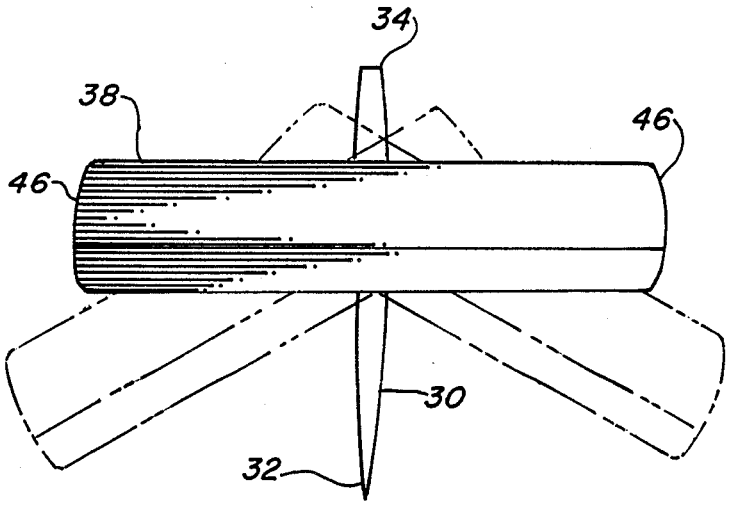
FIG. 15 is a plan view of the vehicle with the airfoil shown in phantom illustrating its normal rotational extremes.
Figure 16:
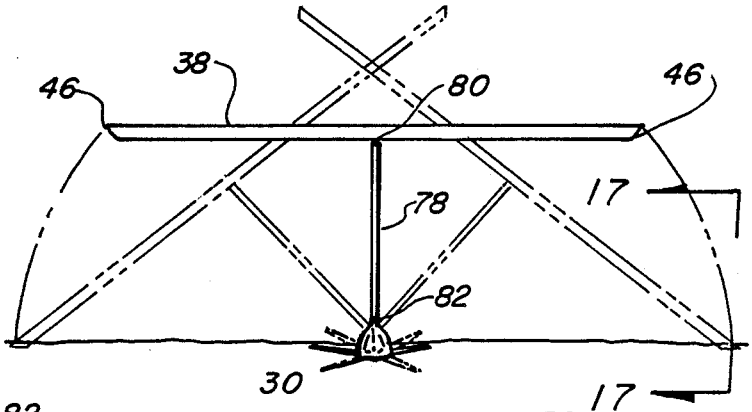
FIG. 16 is a front view of the vehicle in the water with the port and starboard tack configurations illustrated in phantom and the tip at the water surface.
Figure 17:
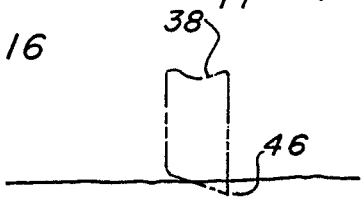
FIG. 17 is a view taken along lines 17—17 of FIG. 16 illustrating in phantom the relationship of the airfoil tip in the water.

The strut 78, best shown in FIG. 18 is in a streamlined shape, and a universal joint 80, connects the strut 78 to the airfoil 38 causing the strut section axis to remain parallel to the airfoil chord which is approximately aligned relative to the wind, thus reducing drag on the strut.

A pivotal joint 82 connects the strut 78 to the hull 30 and is swiveled such that no significant moments are transferred about any axis.

The vehicle also includes means to articulate the airfoil 38 relative to the hull 30 about an axis nearly parallel to the hull's longitudinal axis. This is accomplished by changing the length of the fifth tendon 68.

The means to vary the length of the first through fourth tendons 58, 60, 62 and 64 provides the means to articulate the airfoil 38 relative to the hull 30 about the system near vertical instantaneous axis with the axis close to the vehicle center of gravity and to the airfoil span.

The first and second tendon 58 and 60 together with tendons between the third attachment point 54 and the fourth attaching point 56 incorporate segments to points accessible to the operator forming a first loop. A second similar loop utilizes the third and fourth tendon 62 and 64.

Figure 9:
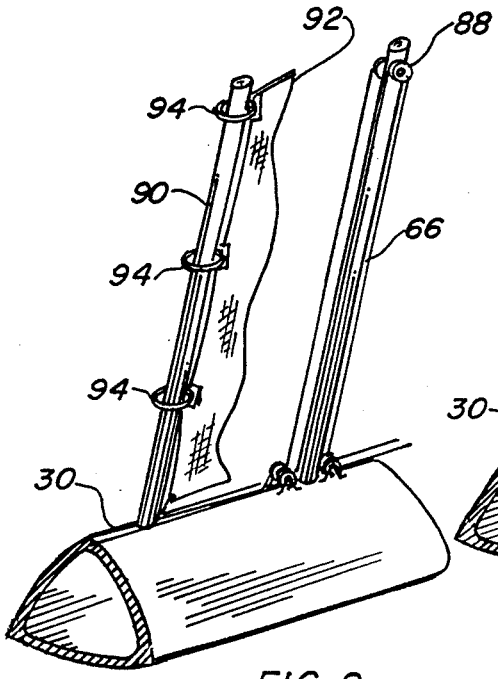
FIG. 9 is a partial isometric view as in FIG. 8 except the payload support sling has been cut away for clarity.

The change in tendons length is accomplished by manually moving the appropriate tendon up or down between a direction changing means 88 attached to the hull 50 and the hull torque link 66 shown best in FIG. 9 attached and isolated in FIG. 14.

The means to change direction of the first through the fourth tendons that form the loops at the points of attachment to the hull 30 also at the junction of the segments, are located to provide ease of accessibility for the operator. The third and fourth attachment points 54 and 56 are positioned to minimize the slack in the first and second loops for the range of length variation required for operation. The first attachment point 50 is approximately above the hull end of the airfoil support strut 78 allowing adjustment of only one loop to move the airfoil 38 about the vertical axis.

The means to vary the length of the sixth tendon 72 is accomplished by manual manipulation. The length controls the angle of attack of the airfoil 38.

The vehicle contains means to support the leeward tip of the airfoil 38 providing vehicle roll resistance in addition to that provided by the hull. This is accomplished by an outwardly tapering shape of the tip element 46 with the forward end inclined upward as shown pictorially in FIGS. 16 and 17.

The invention includes payload supporting means which locates the payload on the windward side of the hull 30.

This includes one or more hull cantilever beams in the hull plane of symmetry each having an upper and lower end with the lower end attached to the hull 30. One of the support beams is the hull torque link 66 and the others are payload support specific cantilever beams 90.

The beams transfer loads applied along their length to the hull interface as a moment and shear. A payload support sling 92 is attached to the beams 66 and 90 transferring loads on the payload to the beams while allowing motion of the payload.

A plurality of rings 94 attach the payload support sling 92 over the hull cantilever beams 66 and 90 allowing transfer of lateral loads from the sling to the beam without preventing longitudinal motion. A tendon direction changing means is attached to the top end of the hull torque link 66 with the fifth tendon 68 routed over the direction changing means and attached to the top end of the payload support sling 92, allowing the sling 92 to collapse toward the hull 30 as the fifth tendon 68 length from the airfoil 38 to direction changing device at the top of the hull torque link 66 is shortened. This arrangement provides a gap between the beams 66 and 90 to allow the payload to cross the hull between the beams when changing tack and the bottom end of said payload support sling 92 is attached to the hull 30 in the hull plane of symmetry. This allows loads to be transferred from the fifth tendon to the sling 92 and retransferred to the hull 30.

Figure 21:
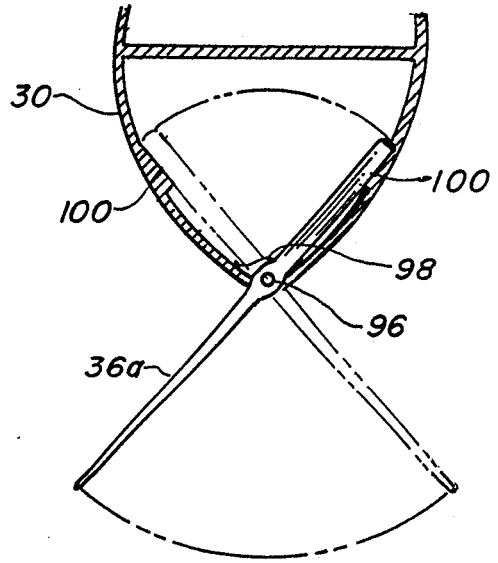
FIG. 21 is a cross-sectional view of the hull illustrating the single main hydrofoil of the second embodiment.
Figure 22:
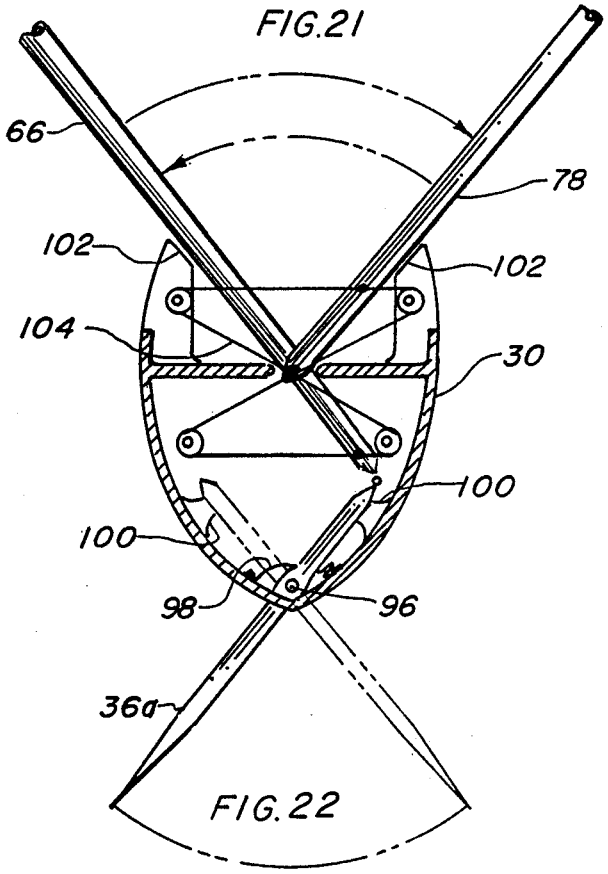
FIG. 22 is a cross-sectional view of the hull illustrating the single main hydrofoil and movable airfoil support strut and torque link.

The second embodiment is identical to the preferred embodiment except for the hydrofoils 36, the hull torque link 66 and an interconnection between the two tendon loops. The hydrofoils differ in that instead of a fixed set illustrated in FIGS. 3 and 6, a plurality of hydrofoils 36*a*, 36*b* are formed in a single set having pivot means 96 relative to the hull 30 with the pivot means axes generally along the hull longitudinal axis and within the hull plane of symmetry. The hydrofoil pivot means axes are tilted upward at their forward end causing a positive hydrofoil angle of attack without yawing the hull 30 and the hydrofoils 36*a*, 36*b* are interconnected to the airfoil positioning means such that motion is coordinated, means are provided to prevent water from entering the hull 30 at the pivot means 96 between the hydrofoils 36*a*, 36*b* and the hull 30 consisting of a resilient seal 98. This embodiment is illustrated in FIGS. 21 and 22. FIG. 21 is in its simplest form with only the hydrofoils 36*a*, 36*b* pivoting. In this embodiment, the hydrofoils 36*a*, 36*b* have symmetrical sections, and contact points with the hull 30 and the hull 30 contains corresponding travel limiting stops 100.

FIG. 22 provides a further alternative to the pivotal hydrofoils 36*a*, 36*b* wherein the hull torque link 66 is slidably pivoted at the interface of the hull 30 allowing two different positions for the torque link 66. The hull torque link 66 has contact points and the hull 30 contains corresponding travel limiting stops 102, where loads on the torque link hold contact points against the stops and the hull torque link 66 is interconnected with movement transmitting means 104 to the airfoil support strut 78 providing coordinated motion.

Figure 10:
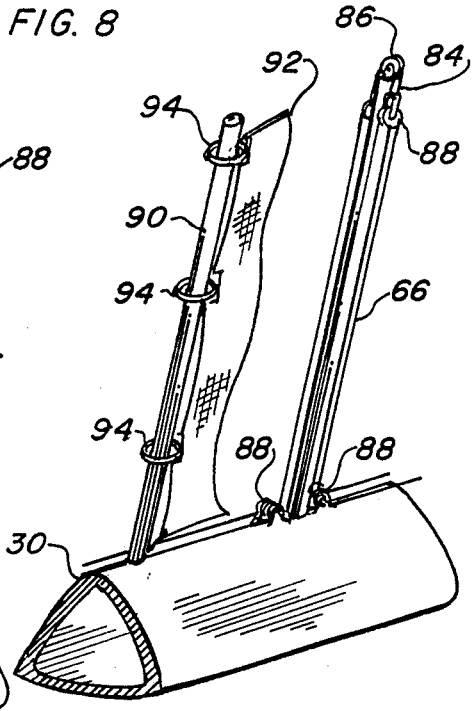
FIG. 10 is the same view as FIG. 9 except an interconnect between the two tendon loops has been added depicting a portion of the second embodiment.

An alternate airfoil positioning means of the vehicle is shown in FIG. 10 allowing adjustment to be made to change the length of the first and second tendons 58 and 60 while simultaneously making an opposite change in length to the third and fourth tendons 62 and 64. This allows the relative leeward offset of the lower tip of the airfoil to be adjusted which shifts the line of action for the airfoil resultant force as an alternative to shifting the position of a payload to maintain the vehicle in equilibrium. This is accomplished by the addition of an interconnecting tendon 84 having a direction changing device 86 on top of the hull torque link 66.

Figures 23, 24:
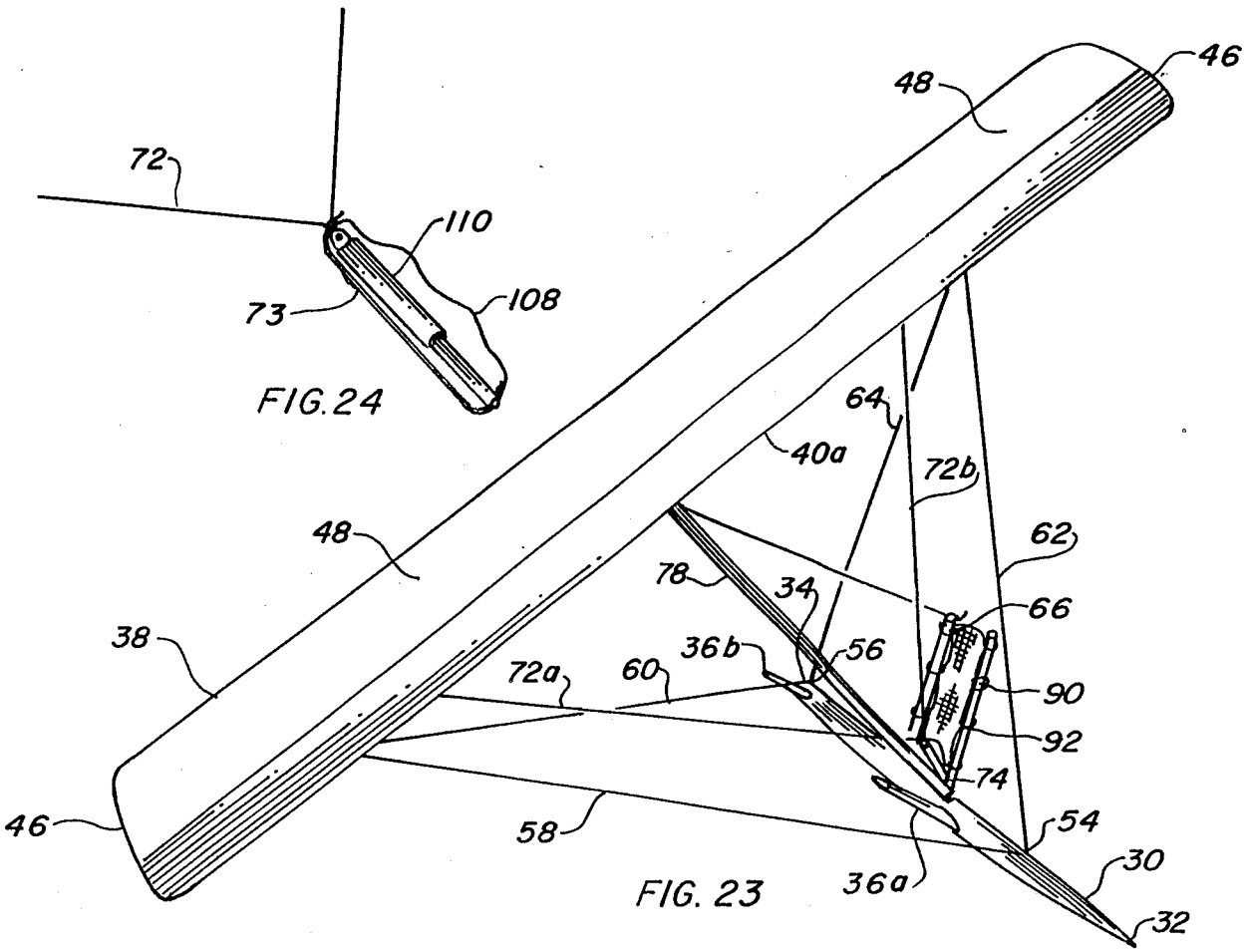
FIG. 23 is a partial isometric of the third embodiment utilizing a torsionally rigid leading edge spar on the airfoil.
FIG. 24 is a view of the third embodiment illustrating the elastic element, overload strut and preload strut of the sixth tendon completely removed from the remainder of the invention for clarity.

The third embodiment illustrated in FIGS. 23 and 24 differs only in the structure of the airfoil and the sixth tendon. The airfoil contains a torsionally rigid leading edge spar 40*a* functioning as the principle spanwise structural element of the airfoil.

Figure 13:
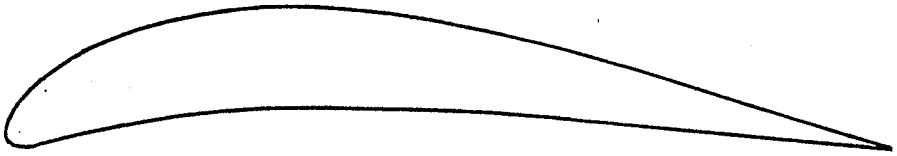
FIG. 13 is a cross-sectional view of the actual cross-sectional outline of the airfoil.

The trailing edge structure 42 is parallel with the torsionally rigid leading edge spar 40*a* having a cross-sectional shape appropriate for the trailing edge spar of the airfoil 38. A membrane covers the external surfaces of the airfoil in the regions bounded by the leading edge spar 40*a*, the trailing edge structural element 42 and the tip elements 46. The shape, as shown in FIG. 13, of the membrane is such that the ratio of the chordwise membrane stress to the chordwise radius of curvature equals the difference between the internal pressure and external aerodynamic pressure.

A plurality of shear transfer devices 106 as shown in FIGS. 11 and 12 are disposed at the leading edge spar 40*a* and the trailing edge structural element 42. This allows a chordwise membrane stress constant over the upper surface of any section and a chordwise membrane stress constant over the lower surface of any section. Where the difference between the contants chordwise membrane stress is reacted by the shear transfer devices 106.

The chordwise section of the leading edge spar 40*a*, trailing edge structural element 42 and airfoil tip elements 46 are consistant with the shape of the membrane 48 and there is no slope discontinuity from the membrane 48 to the leading edge spar 40*a* or the trailing edge structure 42.

The sixth tendon 72 differs in this embodiment by the addition of a flexible segment 73 having an overload strap 108 and a preload strut 110 therearound having the flexibility selected to compensate the airfoil angle of attack as the loading changes.

Figure 25:
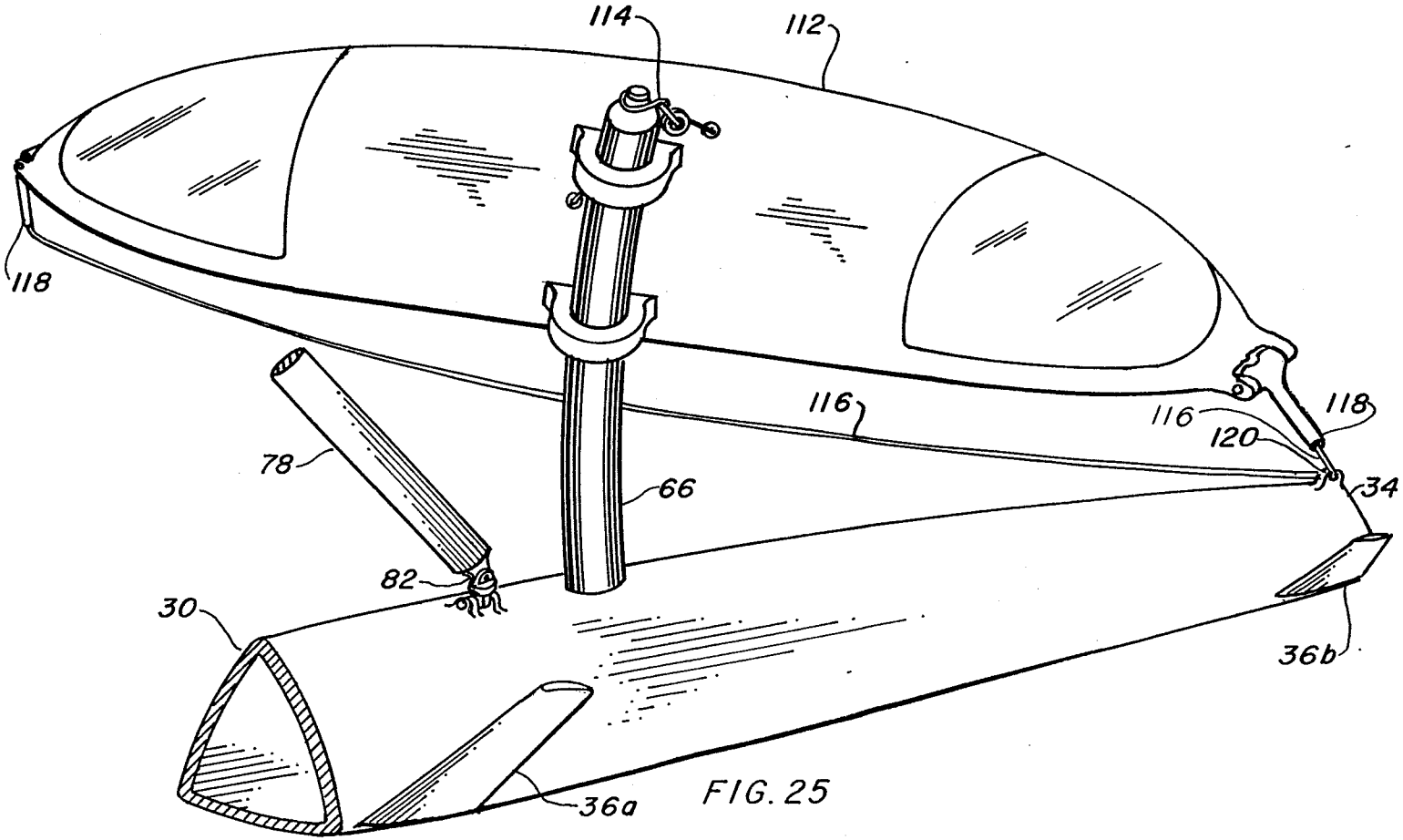
FIG. 25 is a partial isometric view of the fourth embodiment illustrating the payload containing capsule and its controls with the balance of the invention cut away or eliminated for clarity.

The fourth embodiment is illustrated in FIG. 25 and replaces the payload sling 92 with a payload containing capsule 112 having a longitudinal axis, a plane of symmetry perpendicular to the capsule's longitudinal axis and a pivot and slip joint 114 in the plane of symmetry where the capsule which directly supports the payload, is pivoted about and translated along the hull torque link 66 as controlled within the capsule transfering loads from the capsule at the pivot to the torque link 66.

This embodiment further contains a pair of adjustable-length capsule control tendons 116 that are attached on one end to the aft end of the hull 30 and on the other to each end of the payload containing capsule 112, bringing either end of the capsule into close proximity of the hull stern 34 as controlled from within the capsule.

A capsule snubbing device 118 is utilized at each end of the capsule 112, either of which mates with a locating device 120 at the hull stern 34, resisting moments about the pivot axis while allowing translation along the pivot axis.

In operation, the vehicle is placed in the water and the operator or payload is balanced on the hull 30 and leans into the payload support sling 92. Assume the current condition is a near flying starboard tack close to the wind. To tack, start by shifting the airfoil 38 aft to the symmetrical configuration, increase the warp of the airfoil 38 to generate a roll moment on it and move the operator forward on the hull. This shifts the aerodynamic resultant aft relative to the center of gravity and reduces the magnitude, allowing an unbalanced hydrodynamic force to generate yaw rotation and changes the velocity vector into the wind. The operator with the aid of roll unbalance pulls the airfoil 38 across the hull 30. Reaction to unbalanced hydrodynamic lift simultaneously rolls the hull 30. The operator scrambles across the then lowered payload support sling 92. The airfoils 38 is then lowered, shifted forward on the port tack and the warp is reversed. The unbalanced yaw moment due to the drag of the airfoil 38 continues yaw rotation. The operator then if necessary, shortens the aft airfoil lines increasing the airfoil angle of attack to continue yaw rotation.

The operators continues the forward shift of the airfoil 38 until the vehicle starts to accelerate on the port tack. The operator shifts the payload or bends his knees and crouches so the airfoil 38 is not overbalanced.

While the invention has been described in complete detail and pictorially shown in the accompany drawings it is not to be limited to such details, since many changes and modifications may be made in the invention without departing from the spirit and the scope thereof. Hence, it is described to cover any and all modifications and forms which may come within the language and scope of the appended claims.

I claim:

1. A water-air interface vehicle that supports and propels a payload and which has at any moment a windward and a leeward side, said vehicle comprising:

(a) a long narrow hull having a plane of symmetry and a longitudinal axis in that plane of symmetry, and a bow and a stern, said hull partially supporting said vehicle, in the water at low speeds by displacing a volume of water of equal weight, (b) a plurality of hydrofoils symmetrically attached to said hull, partially supporting the vehicle and resisting lateral loads on other parts of the vehicle at high speeds relative to the water, (c) an airfoil having a tip element on each of the two ends of its span and a plane of symmetry perpendicular to its span, said airfoil partially supporting and providing thrust to propel said vehicle through the water, (d) an airfoil positioning means disposed between said hull and said airfoil locating the airfoil offset to the leeward side of the hull with one tip element further to the leeward and lower than the other, (e) means to articulate said airfoil relative to the hull about an axis nearly parallel to the hull's longitudinal axis and a near vertical instantaneous axis, (f) means to support the leeward tip element of the airfoil, providing vehicle roll resistance in addition to that provided by the hull, and (g) a payload supporting means which locates the payload on the windward side of the hull.

2. The vehicle as recited in claim 1 wherein said hull further comprises a section area distribution independent of the volume of water displaced and water surface width distribution independent of the volume of water displaced thus maintaining similar hull hydrostatic, hydrodynamic and stability properties for said hull as displacement changes.

3. The vehicle as recited in claim 2 wherein said hull further comprises a shape that corresponds to the following formula:

let L be the waterline length projected on a longitudinal tangent at the stern; given a stern submergence H, a waterline width equal to the product of a constant width distribution b(x) times the stern width B(H) and a bow offset from the longitudinal tangent at the stern to the water surface proportional to H, where x is the distance along the tangent from the stern divided by L; the area distribution will be constant if the stern area (A) is proportional to a power of L, therefore:

$$A = \int_{o}^{H} B(h)dh = C_2L^{C_3}$$

the ratio of tangent offset to stern submergence $(1+C_1)$ as well as $C_2$, $C_3$, and the distributions b(x) and B(H) are arbitrary except the value of b must be unity at the stern, $$b(o)=1$$

the section area (A(x)) is equal to the product of A which is a function of H and the constant area distribution (a(x)) which is a function of x not L, therefore:

$$a(x) = C_3x^{C_3} \int_{x}^{1} b(y)(1 + C_1y)/y^{1+C_3}dy$$

4. The vehicle as recited in claim 1 further comprising a vehicle center of gravity associated with the mass of vehicle plus the payload, at least one section slope discontinuity on the surface of said hull, having an internal angle at the discontinuity of less than 180 degrees allowing a volume displacement less than a smooth contour and where said plurality of hydrofoils form at least one set where each set includes a main foil and at least one smaller foil and where all elements of a set are attached near a single discontinuity providing greater submergence of the foils than if attached to a smooth contour and said sets are attached in a symmetrical pattern on said hull, where said main hydrofoils are disposed upon said hull close to and forward of the vehicle center of gravity and each smaller foil is located on said hull aft of the center of gravity with the smaller aft foils having a smaller angle of attack relative to the water than said main foils providing pitch stability.

5. The vehicle as recited in claim 4 wherein said plurality of hydrofoils further comprise a first and a second sets of hydrofoils, said first set of hydrofoils being cambered for and used on a starboard tack and said second set of hydrofoils being cambered for and used on a port tack where said foils develop forces in the opposite direction for opposed tacks.

6. The vehicle as recited in claim 4 further comprising:

(a) said plurality of hydrofoils formed in a single set having pivot means relative to the hull with the pivot means axes generally along said hull longitudinal axis and within said hull plane of symmetry where said hydrofoil pivot means axes are tilted upward at their forward end causing a positive angle of attack without yawing the hull and said hydrofoils are interconnected to said airfoil positioning means such that motion is coordinated, (b) means to prevent water entering the hull at said pivot means between the hydrofoils and the hull, (c) said hydrofoils having symmetrical sections, and (d) said hydrofoils having contact points with said hull, where said hull has corresponding travel limiting stops.

7. The vehicle as recited in claim 1 wherein said airfoil tip elements further comprises a contoured shape suitable for planing on a water surface this being said means to support the leeward tip element of said airfoil.

8. The vehicle as recited in claim 1 wherein said airfoil further comprises:

(a) a torsional rigid leading edge spar, defining the principal spanwise structural element of the airfoil, (b) a trailing edge structural element parallel with said leading edge spar having a cross-sectional shape appropriate for the trailing edge spar of said airfoil, (c) said airfoil tip elements attached at each end of said leading edge spar with each tip element having an appropriate aerodynamic shape forming its outwardly extending boundary, (d) a membrane covering the external surface of said airfoil in the regions bounded by the leading edge spar, the trailing edge structural element and said tip elements, where a section of said membrane is such that the ratio of chordwise membrane stress to chordwise radius of curvature equals the difference between the internal pressure and external aerodynamic pressure, (e) a plurality of shear transfer devices disposed at the leading edge spar and the trailing edge structural element, (f) a chordwise membrane stress constant over upper surface of said section, (g) a chordwise membrane stress constant over lower surface of said section, where the difference between constants of said chordwise membrane stress is reacted by said shear transfer devices, and (h) said leading edge spar, trailing edge structural element and airfoil tips have a shape consistant with said section of the membrane and where there is no slope discontinuity from said membrane to said leading edge spar or trailing edge structural element.

9. The vehicle as recited in claim 1 wherein said airfoil positioning means further comprises:

(a) a first attachment point on the airfoil near the windward end and a second attachment point symmetric relative to the first attachment point near the leeward end, (b) a third attachment point located in the hull plane of symmetry near the bow and a fourth attachment point located in the hull plane of symmetry near the stern, (c) a first tendon attached on one end to the first attachment point and on the other to the third attachment point, (d) a second tendon attached on one end to the first attachment point and on the other to the fourth attachment point, (e) a third tendon attached on one end to the second attachment point and on the other to the third attachment point, (f) a fourth tendon attached on one end to the second attachment point and on the other to the fourth attachment point, said first through fourth tendons form four of the edges of a tetrahedron, the portion of said hull from the third to fourth attachment points and the portion of said airfoil from the first to second attachment points form the other two edges, where said tendons transmit loads imposed on said airfoil to said hull, (g) a hull torque link, having an upper and a lower end, attached on the lower end to said hull in the hull plane of symmetry allowing rotational loads imposed on the hull by said hydrofoils to be reacted by a force at the upper end, (h) a fifth tendon attached on one end to said hull torque link upper end and the other end to said airfoil in the airfoil plane of symmetry, balancing moments on said hull due to the weight of said airfoil on the hull leeward side with moments on said hull from the weight of the payload on the hull windward side, (i) at least one airfoil torque link, having a forward and an aft end with the forward end attached to said airfoil allowing rotational loads on said airfoil imposed by aerodynamic forces to be reacted by forces on the aft end, (j) a sixth tendon composed of at least one airfoil pitch control tendon each attached on one end to one of said airfoil torque link aft ends and on the other end to a fifth attachment point on said hull on the hull plane of symmetry, for transmitting loads from the hull attachment to the airfoil torque links aft ends, and (k) an airfoil support strut attached on one end to said airfoil near the tetrahedron edge between said first and second attachment points in the airfoil plane of symmetry and on the other end to the hull near the tetrahedron edge between said third and fourth attachment points in the hull plane of symmetry transmitting axial loads from the airfoil to the hull.

10. The vehicle as recited in claim 9 wherein:

(a) a said airfoil is warpable which allows compensation for the variation in relative wind direction at different distances above the water and adjusting the distribution of pressure along the airfoil span, further, said airfoil having a torsionally flexible leading edge spar characterising the principal spanwise structural element in the airfoil allowing airfoil warping while maintaining the initial relative position of other elements of the airfoil attached to the leading edge spar, (b) said sixth tendon composed of at least two airfoil pitch control tendons, allowing airfoil warping and control, where said airfoil includes at least two airfoil torque links, one associated with each pitch control tendon, widely separated from each other and kinematically attached to the airfoil, allowing controlled warping, and (c) said pitch control tendons forming the sixth tendon having a length at their hull end coalesced into a single element with said length selected to coordinate airfoil warping with respect to airfoil loading.

11. The vehicle as recited in claim 9 further comprising:

(a) means to vary the length of said first through fourth tendons where the changing of the first through fourth tendons length provides the means to articulate the airfoil relative to the hull about said near vertical instantaneous axis where the axis is close to the vehicle center of gravity and to the airfoil spanwise axis, (b) means to vary the length of said fifth tendon where the changing of the fifth tendon's length provides the means to roll the hull relative to the airfoil about an axis nearly parallel to the hull's longitudinal axis, and (c) means to vary length of said sixth tendon to change the airfoil angle of attack.

12. The means to vary the length of the first through fourth tendon as recited in claim 11 further comprising:

(a) said first and second tendons together with tendons located between said third attachment point and said fourth attaching point which incorporates segments to points accessible to the operator forming a first loop, (b) a second similar loop utilizing said third and fourth tendon, and (c) means to change direction of said tendons forming the loops at said points of attachment to said hull and at the juncture of said segments to points accessible to the operator, where said third and fourth attachment points are positioned to minimize the slack in said first and second loops for the range of length variation required for operation, said first attachment point being approximately above the hull end of the airfoil support strut allowing adjustment of only one loop to move said airfoil about the vertical axis.

13. The hull torque link of the vehicle as recited in claim 9 further being rigidly attached directly to said hull.

14. The vehicle as recited in claim 9 further comprising said hull torque link pivoted at the interface to said hull, allowing two different positions for the hull torque link, said hull torque link having contact points and the hull having corresponding travel limiting stops, where loads on the hull torque link hold contact points against the stops and said hull torque link interconnected to said airfoil positioning means defining coordinated motion with no operator intervention.

15. The sixth tendon of the vehicle as recited in claim 9 further comprising said fifth attachment point being positioned to coordinate airfoil angle of attack with the airfoil rotation about a near vertical instantaneous axis.

16. The sixth tendon of the vehicle as recited in claim 9 further comprising a flexible segment having an overload strap and a preload strut therearound having the flexibility selected to compensate the airfoil angle of attack as the loading changes.

17. The airfoil support strut of the vehicle as recited in claim 9 further comprising a streamlined section, and a universal joint, connecting said strut to said airfoil, which causes said strut section axis to remain parallel to the airfoil chord which is approximately aligned with the relative wind, thus reducing drag.

18. The payload support means of the vehicle as recited in claim 9 further comprising:

(a) at least two hull cantilever beams in the hull plane of symmetry each having an upper and lower end with the lower end attached to said hull where one cantilever beam is said hull torque link, where the other cantilever beams are payload support specific beams, where said beams transfer loads applied along their length to the hull interface as a moment and shear and, (b) a payload support sling attached to said beams transferring loads on the payload to the beams while allowing motion of the payload.

19. The payload support sling of the vehicle as recited in claim 18 further comprising:

(a) a plurality of rings on said payload support sling over said hull cantilever beams that transfer lateral loads from the sling to the beams without preventing longitudinal motion, and (b) tendon direction changing means attached at the top end of said hull torque link with said fifth tendon routed over said direction changing means and attached to the top end of said payload support sling, allowing the sling to collapse toward the hull as the fifth tendon length from the airfoil to direction changing device at the top of the hull torque link is shortened, providing a gap between the beams to allow the payload to cross the hull between the beams when changing tack and where the bottom end of said payload support sling is attached to said hull in the hull plane of symmetry allowing loads transferred to the sling to be retransferred to the hull.

20. The vehicle as recited in claim 9 wherein said payload support means further comprises:

(a) a payload containing capsule having a longitudinal axis, a plane of symmetry perpendicular to the capsule's longitudinal axis and a pivot and slip joint in said plane of symmetry where said capsule directly supports the payload, and which is pivoted about and translated along said hull torque link as controlled from within the capsule transfering loads from the capsule at the pivot to the hull torque link, (b) a pair of adjustable-length capsule control tendons attached on one end to the aft end of said hull and on the other to each end of said payload containing capsule, bringing either end of the capsule to close proximity of the hull stern controlled from within the capsule, and (c) a capsule snubbing device at each end of said capsule, either of which mates with a locating device at the hull stern, resisting moments about the pivot axis while allowing translation along the pivot axis.

21. The airfoil positioning means of the vehicle as recited in claim 9 further comprising means to change the length of said first and second tendons and simultaneously make the opposite change in length to said third and fourth tendons, allowing the relative leeward offset of the lower tip of the airfoil to be adjusted which shifts the line of action for the airfoil resultant force as an alternative to shifting the position of the payload to maintain the vehicle in equilibrium.

* * * * *